US008960144B2

(12) United States Patent
Hiramatsu et al.

(10) Patent No.: US 8,960,144 B2
(45) Date of Patent: Feb. 24, 2015

(54) VARIABLE VALVE MECHANISM OF INTERNAL COMBUSTION ENGINE

(71) Applicant: Otics Corporation, Nishio-shi (JP)

(72) Inventors: Naoki Hiramatsu, Nishio (JP); Koki Yamaguchi, Nishio (JP); Akira Sugiura, Nishio (JP); Takayuki Maezako, Nishio (JP)

(73) Assignee: Otics Corporation, Nishio-Shi, Aichi-Ken (JP)

( * ) Notice: Subject to any disclaimer, the term of this patent is extended or adjusted under 35 U.S.C. 154(b) by 0 days.

(21) Appl. No.: 14/032,116

(22) Filed: Sep. 19, 2013

(65) Prior Publication Data

US 2014/0083380 A1 Mar. 27, 2014

(30) Foreign Application Priority Data

Sep. 21, 2012 (JP) ..... 2012-208136

(51) Int. Cl.

| | |
|---|---|
| ***F01L 1/18*** | (2006.01) |
| ***F01L 1/34*** | (2006.01) |
| ***F01L 13/00*** | (2006.01) |
| *F01L 1/46* | (2006.01) |

(52) U.S. Cl.

CPC . *F01L 1/34* (2013.01); *F01L 1/185* (2013.01); *F01L 13/0005* (2013.01); *F01L 2001/186* (2013.01); *F01L 2001/467* (2013.01); *F01L 2105/00* (2013.01)

USPC ..... 123/90.39; 123/90.44; 123/90.45; 123/90.46; 74/559; 74/569

(58) Field of Classification Search

USPC ..... 123/90.39, 90.44, 90.45, 90.46; 74/559, 74/569

See application file for complete search history.

(56) References Cited

U.S. PATENT DOCUMENTS

| | | | | |
|---|---|---|---|---|
| 4,151,817 | A | 5/1979 | Mueller | |
| 5,669,342 | A | 9/1997 | Speil | |
| 6,318,317 | B1 | 11/2001 | Hubschle | |
| 6,321,705 | B1 | 11/2001 | Fernandez et al. | |
| 8,215,275 | B2 * | 7/2012 | Church | 123/90.39 |
| 2001/0035140 | A1 | 11/2001 | Fernandez et al. | |

(Continued)

FOREIGN PATENT DOCUMENTS

| | | | |
|---|---|---|---|
| DE | 27 53 197 | A1 | 6/1978 |
| DE | 198 01 964 | A1 | 7/1999 |

(Continued)

OTHER PUBLICATIONS

Extended European Search Report dated Feb. 3, 2014.

*Primary Examiner* — Ching Chang

(74) *Attorney, Agent, or Firm* — McGinn IP Law Group, PLLC

(57) ABSTRACT

The present invention provides a variable valve mechanism of an internal combustion engine, which includes a main arm having at a rear end thereof a supported portion that is continuously supported swingably by a support member without floating upward, a sub arm which has a tip end to which a roller contacting a cam is rotatably attached, in which a center of the roller is located rearward of the pressing portion and forward of a swing center of the supported portion, which has a rear end that is swingably supported with respect to the main arm by a support pin, and in which a center of the support pin is located rearward of the center of the roller and forward of the swing center of the supported portion, and a switch pin that is inserted in a central portion of the roller.

11 Claims, 11 Drawing Sheets

(56) References Cited

U.S. PATENT DOCUMENTS

| | | | |
|---|---|---|---|
| 2003/0230270 | A1 | 12/2003 | Seitz |
| 2005/0132990 | A1 | 6/2005 | Haas et al. |

FOREIGN PATENT DOCUMENTS

| | | | |
|---|---|---|---|
| DE | 10 2004 029 555 | A1 | 1/2006 |
| DE | 102004048289 | A1 | 4/2006 |
| EP | 1 972 761 | A1 | 9/2008 |
| EP | 2 662 540 | A1 | 11/2013 |
| JP | 4-116211 | A | 4/1992 |
| JP | 10-212913 | A | 8/1998 |
| JP | 2003-254024 | A | 9/2003 |
| JP | 2008-208746 | A | 9/2008 |

* cited by examiner

VARIABLE VALVE MECHANISM OF INTERNAL COMBUSTION ENGINE

TECHNICAL FIELD

The present invention relates to variable valve mechanisms that switch the drive state of a valve according to the operating condition of an internal combustion engine.

BACKGROUND ART

There are valve mechanisms having a swing rocker arm in which a pressing portion that presses a valve is provided at its tip end, and the rear end of the swing rocker arm is swingably supported. Among such valve mechanisms, there are valve mechanisms in which the rocker arm has a double structure formed by a main arm and a sub arm, and the valve is switched between the driven state and the stopped state or the working angle (lift amount) of the valve is switched by coupling and decoupling the sub arm to and from the main arm, as shown in Patent Literatures 1 to 6.

CITATION LIST

Patent Literature

Patent Literature 1: German Patent Application Publication No. 102004048289

Patent Literature 2: Japanese Patent Application Publication No. 2003-254024

Patent Literature 3: United States Patent Application Publication No. 2005/132990

Patent Literature 4: Japanese Patent Application Publication No. 2008-208746

Patent Literature 5: United States Patent Application Publication No. 2003/230270

Patent Literature 6: Japanese Patent Application Publication No. H10-212913

SUMMARY OF INVENTION

Technical Problem

However, the variable valve mechanisms shown in the above documents have the following problems (A) to (F).

(A) In Patent Literature 1 and Patent Literature 2, a switch pin does not fit in the centerline of a roller, which increases the size of the main arm and the sub arm.

(B) In Patent Literature 1 and Patent Literature 2, the switch pin that performs coupling and decoupling operations is disposed at the rear end of the main arm. Accordingly, the swing center of the sub arm with respect to the main arm in the decoupling operation is not located at the rear end of the main arm, but at the tip end thereof. This increases inertial mass upon swinging of the main arm supporting the sub arm. In Patent Literature 3 and Patent Literature 4, the swing center of the sub arm with respect to the main arm in the decoupling operation is located at the same position as the swing center of the main arm and the sub arm in the coupling operation. In Patent Literature 5, the swing center of the sub arm with respect to the main arm in the decoupling operation is located above the swing center of the main arm and the sub arm in the coupling operation. Thus, the length of the sub arm is necessarily increased in the longitudinal direction.

(C) In Patent Literature 6, the rear end of the main arm swingably supported by the support member may float from the support member, whereby support of the main arm becomes unstable.

(D) In Patent Literature 3 and Patent Literature 5, a supported portion that is swingably supported by a hemispherical support portion of a lash adjuster is provided in the sub arm located inward of the main arm. Therefore, the width of the inner sub arm needs to be made larger than the diameter of the supported portion by a predetermined amount or more. Moreover, the width of the outer main arm needs to be made larger than that of the sub arm.

(E) In Patent Literature 4 and Patent Literature 6, a shift device (hydraulic mechanism) that shifts a switch pin is provided inside the main arm. This increases the weight and size of the main arm.

(F) In Patent Literature 6, the shift device (hydraulic mechanism) is provided inside the main arm, and the main arm is wide in the lateral direction. It is therefore difficult for the variable valve mechanism to have a single-valve drive structure that drives one valve by one main arm. The variable valve mechanism has a two-valve simultaneous drive structure that simultaneously drives two valves by one main arm. Accordingly, the two valves cannot be driven with different drive amounts or at different timings, and valve clearance needs to be balanced between the two valves.

It is an object of the present invention to solve the above problems (A) to (F).

Solution to Problem

In order to solve the problems (A) to (C), a variable valve mechanism of an internal combustion engine according to the present invention includes: a main arm having at a tip end thereof a pressing portion that presses a valve, and having at a rear end thereof a supported portion that is continuously supported swingably by a support member without floating upward; a sub arm which is disposed next to the main arm, which has a tip end to which a roller contacting a cam is rotatably attached, in which a center of the roller is located rearward of the pressing portion and forward of a swing center of the supported portion, which has a rear end that is swingably supported with respect to the main arm by a support pin, and in which a center of the support pin is located rearward of the center of the roller and forward of the swing center of the supported portion; and a switch pin that is inserted in a central portion of the roller, and that can be shifted between a coupling position where the sub arm is coupled to the main arm so as not to allow the sub arm to swing relative to the main arm, and a non-coupling position where the coupling between the sub arm and the main arm is released.

The position of the center of the support pin is not particularly limited more than the above. However, it is preferable that the distance from the center of the support pin to the swing center of the supported portion be 0.5 to 1.5 times the distance from the center of the support pin to the center of the roller as viewed from a side. If the distance from the center of the support pin to the swing center of the supported portion is less than 0.5 times the distance from the center of the support pin to the center of the roller, the support pin is located too close to the supported portion, and the length of the sub arm cannot be sufficiently reduced in the longitudinal direction, and thus the weight of the sub arm cannot be sufficiently reduced. If the distance from the center of the support pin to the swing center of the supported portion is more than 1.5 times the distance from the center of the support pin to the center of the roller, the support pin is located too close to the roller, and a sufficient stroke may not be ensured when the sub arm swings relative to the main arm. The distance from the center of the support pin to the swing center of the supported portion is more preferably 0.6 to 1.3 times, and more preferably 0.7 to 1.1 times the distance from the center of the support pin to the center of the roller. The reason for this is similar to that described above.

Although the support member is not particularly limited, examples of the support member include a plunger of a lash adjuster including at its upper end a hemispherical support portion supporting the supported portion, a rocker shaft extending through the rear end of the main arm in the lateral direction.

In order to solve the problem (D), it is preferable that the main arm be an outer arm located laterally outward of the sub arm, and the sub arm be an inner arm located laterally inward of the main arm, and the support member be a plunger of a lash adjuster which includes at an upper end thereof a hemispherical support portion that supports the supported portion.

With this configuration, the supported member supported by the plunger is disposed in the outer arm (main arm) rather than in the inner arm (sub arm). This eliminates the restriction that the width of the inner arm (sub arm) needs to be larger than the diameter of the supported portion by a predetermined amount or more. Thus, the inner arm (sub arm) can be reduced in size in the lateral direction. Accordingly, the outer arm (main arm) can also be reduced in size in the lateral direction.

In order to solve the problem (E), a shift device that shifts the switch pin and that does not swing together with the main arm and the sub arm is preferably provided outside the main arm and the sub arm. In this case, the main arm and the sub arm can be reduced in weight and size as compared to the case where the shift device is provided inside the main arm and the sub arm. Since the main arm is reduced in size in the lateral direction, the main arm can be used as a single-valve drive arm.

In order to solve the problem (F), the main arm is preferably a single-valve drive arm that drives only one valve. By providing two single-drive main arms for two valves, the two valves can be driven with separate driving amounts and at separate timings, and two valve clearances can be separately automatically adjusted by respective lash adjusters. Namely, the valve clearance need not be balanced between the two valves.

A specific form of the main arm is not particularly limited, but the main arm preferably includes two side plate portions arranged side by side at an interval in a lateral direction of the main arm, an arm tip end connecting tip ends of the side plate portions and provided with the pressing portion, and an arm rear end connecting rear ends of the side plate portions and provided with the supported portion. Thus, a lightweight main arm can be formed.

A specific form of the sub arm is not particularly limited, but it is preferable that the sub arm include two inner plate portions that are arranged between the side plate portions and side by side at an interval in a lateral direction of the sub arm, and a bottom plate portion connecting lower ends of tip ends of the inner plate portions, the roller be attached between the tip ends of the inner plate portions located above the bottom plate portion, and rear ends of the inner plate portions be swingably supported on the side plate portions by the support pin. Thus, a lightweight sub arm can be formed.

The support pin may be a single continuous pin. However, in the case where the interval between the roller and the supported portion in the longitudinal direction is small, the support pin is preferably configured as follows in order to avoid interference with the roller. That is, it is preferable that the main arm include two side plate portions arranged side by side at an interval in a lateral direction of the main arm, the sub arm include two inner plate portions that are arranged between the side plate portions and side by side at an interval in a lateral direction of the sub arm, and the roller be attached between tip ends of the inner plate portions, the support pin be divided into two support pins, one of the support pins swingably support a rear end of one of the inner plate portions on an adjoining one of the side plate portions, and the other support pin swingably support a rear end of the other inner plate portion on the other adjoining side plate portion, and an outer edge of the roller be placed between the one support pin and the other support pin.

The main arm and the sub arm may be configured so that only the sub arm contacts the cam. However, the main arm and the sub arm may be configured so that the sub arm contacts the cam and the main arm contacts another cam different from the cam. In the latter case, the main arm and the sub arm are not specifically limited, but it is preferable that the main arm include two side plate portions arranged side by side at an interval in the lateral direction of the main arm, the sub arm be placed between the side plate portions, and a slide contact portion that slide-contacts the another cam different from the cam be formed in the upper end of each of the side wall portions by sheet-metal working. This is because a lightweight slide contact portion can be easily formed. The another cam may be a low lift cam having a lift amount smaller than that of the cam, or may be an idle cam having only a base circle.

Advantageous Effects of Invention

According to the variable valve mechanism of the present invention, the switch pin is inserted through the central portion of the roller. Therefore, the switch pin fits on the centerline of the roller, whereby the main arm and the sub arm can be made compact. Accordingly, the variable valve mechanism of the present invention can solve the problem (A).

Since the center of the support pin swingably supporting the rear end of the sub arm is located rearward of the center of the roller, inertial mass upon swinging of the main arm supporting the sub arm is smaller, as compared to the case where the center of the support pin is located forward of the center of the roller. Since the center of the support pin is located forward of the swing center of the supported portion, the length of the sub arm is smaller in the longitudinal direction and the weight and size of the sub arm is also smaller, as compared to the case where the center of the support pin is located at the same position as or on the lateral side of the swing center of the supported portion, or located upward of the swing center of the supported portion. Accordingly, the variable valve mechanism of the present invention can solve the problem (B).

Since the supported portion of the main arm is continuously supported by the support member without floating upward, support of the main arm by the support member does not become unstable. Accordingly, the variable valve mechanism of the present invention can solve the problem (C).

DESCRIPTION OF EMBODIMENTS

First Embodiment

Figure 1:
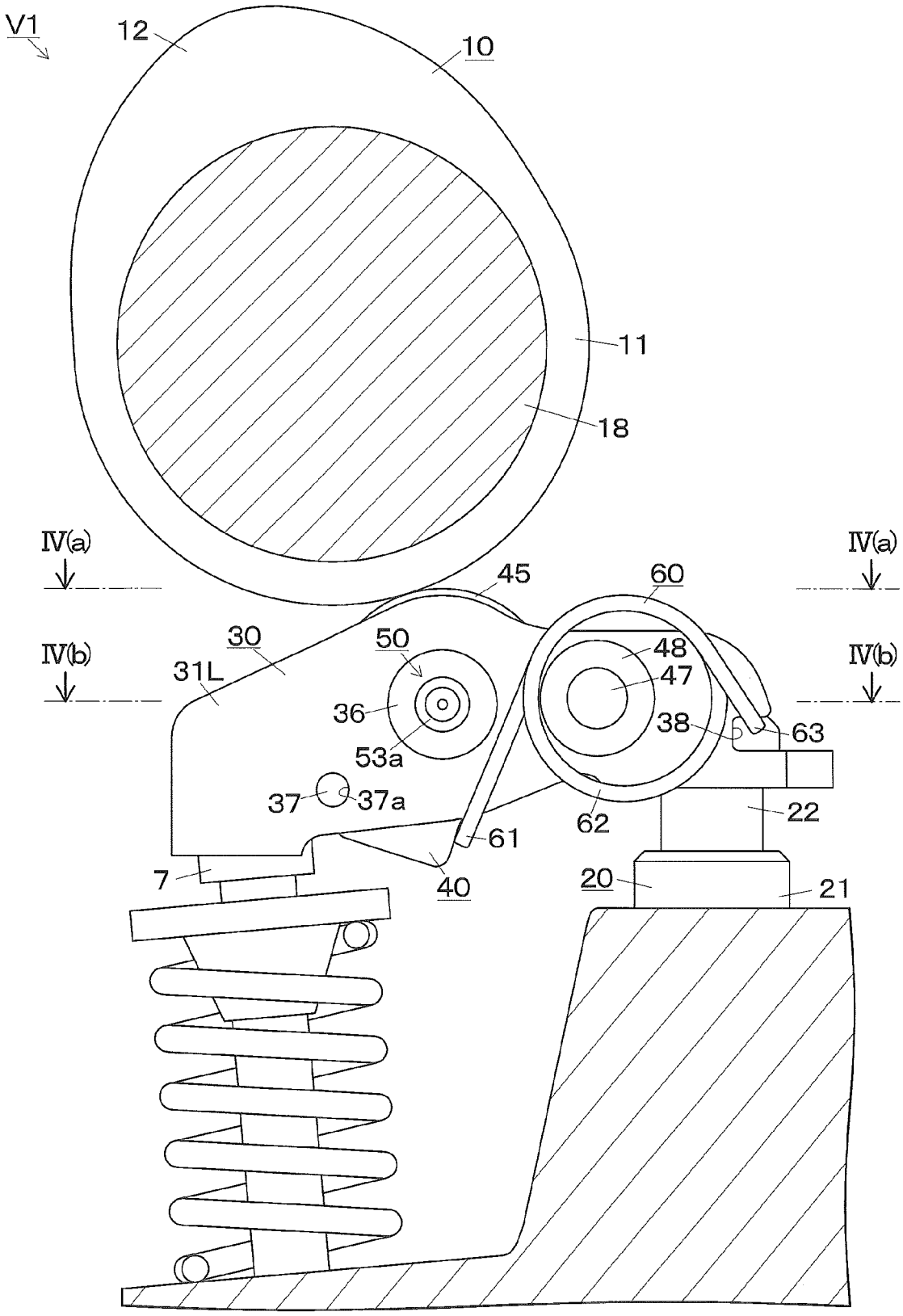
FIG. 1 is a side view showing a variable valve mechanism of a first embodiment.
Figure 2:
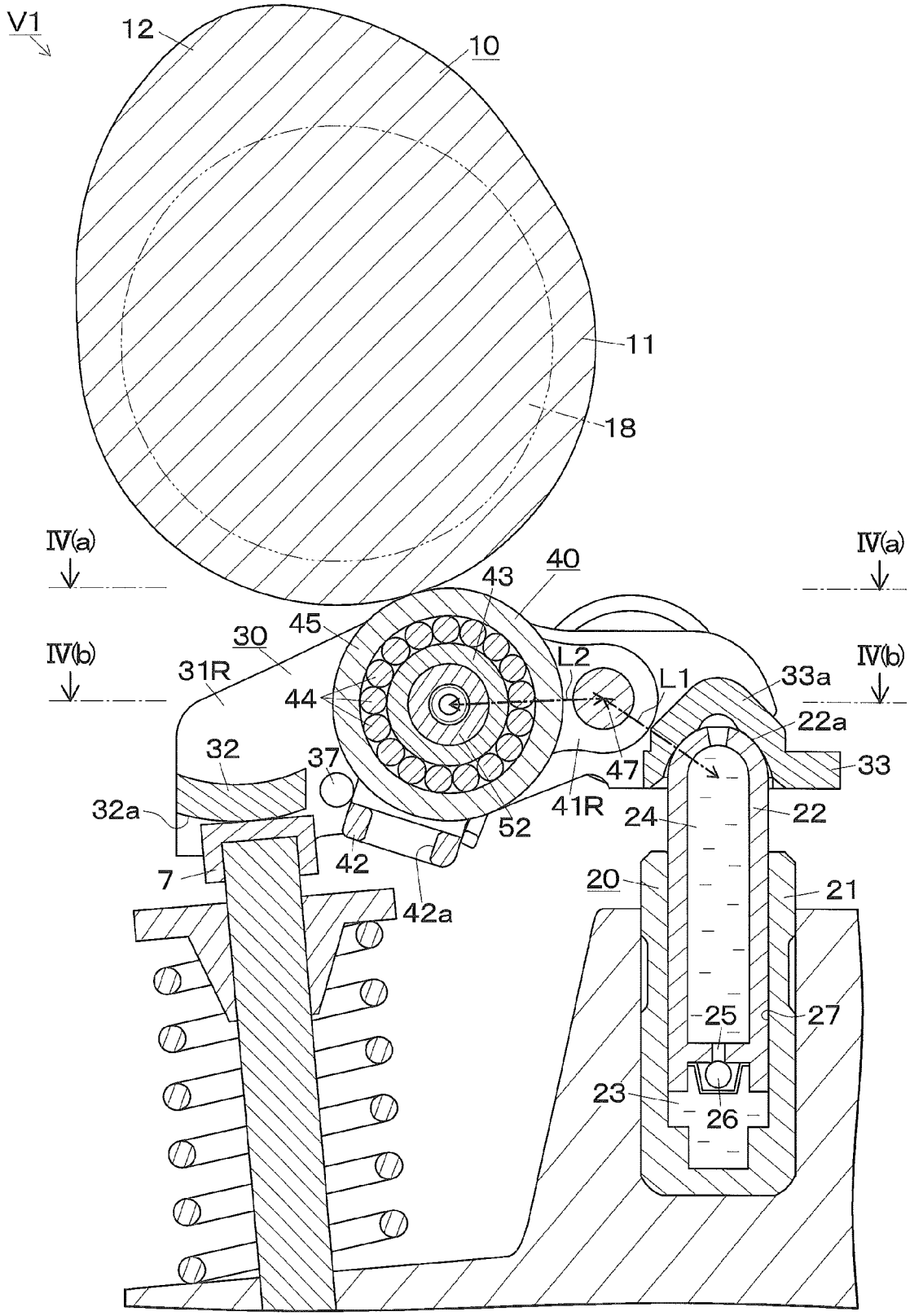
FIG. 2 is a side sectional view showing the variable valve mechanism of the first embodiment.
Figure 3:
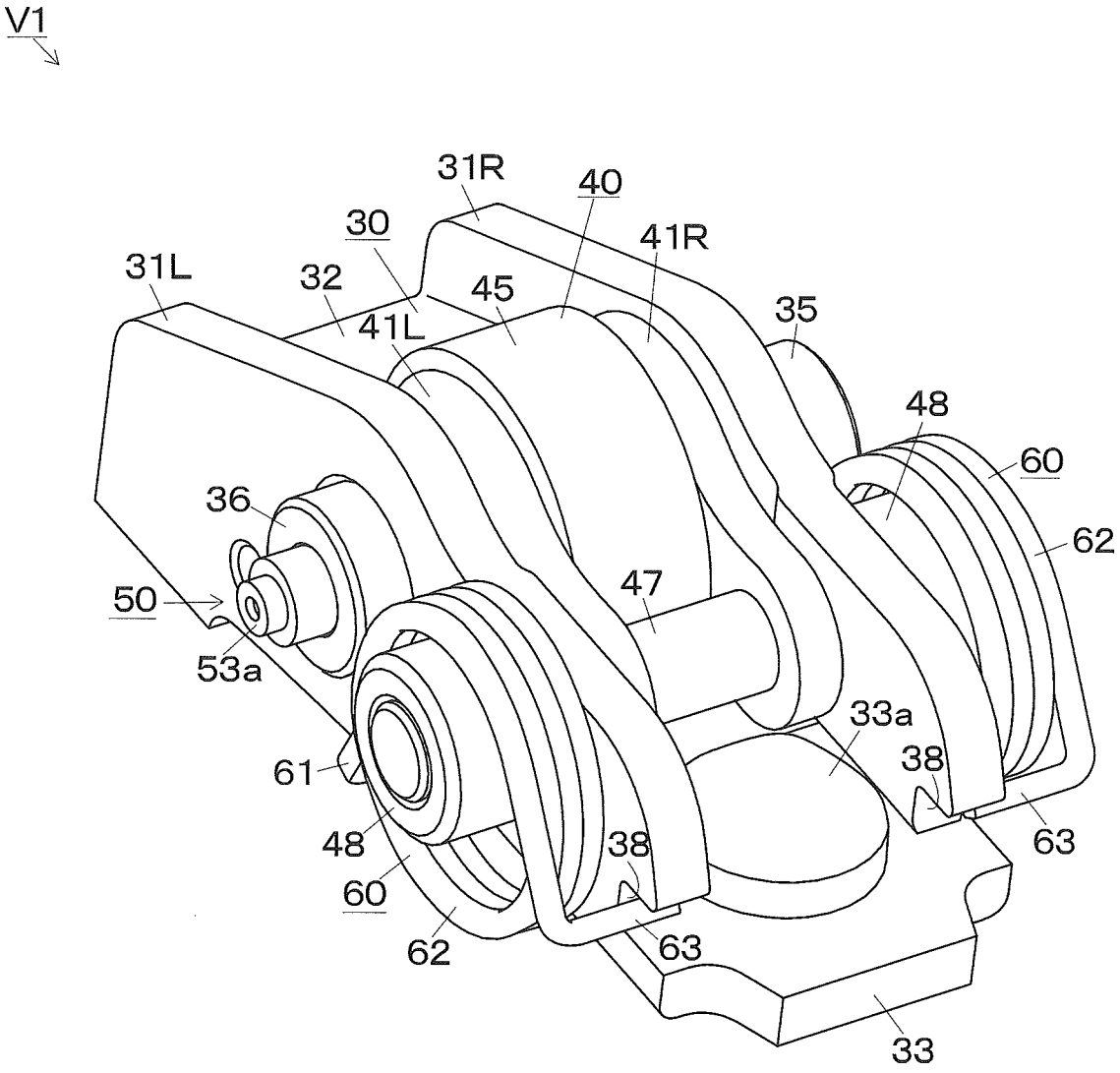
FIG. 3 is a perspective view showing a main arm and a sub arm of the variable valve mechanism of the first embodiment.
Figure 4A:
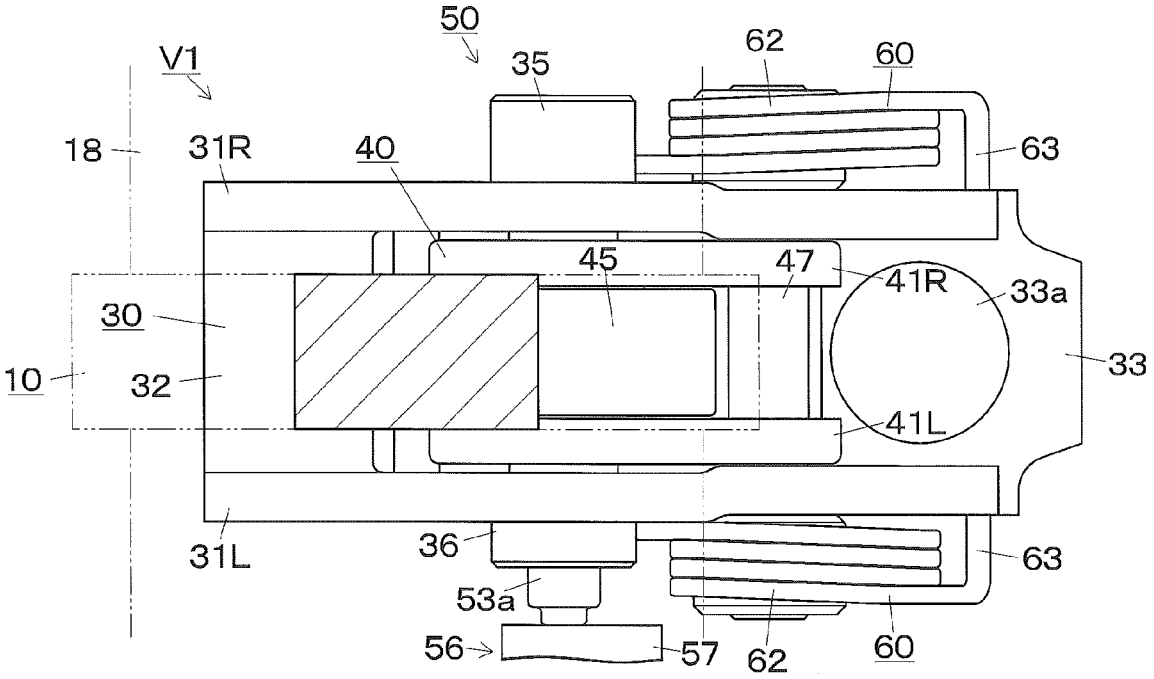
FIG. 4A is a plan view showing the variable valve mechanism of the first embodiment.
Figure 4B:
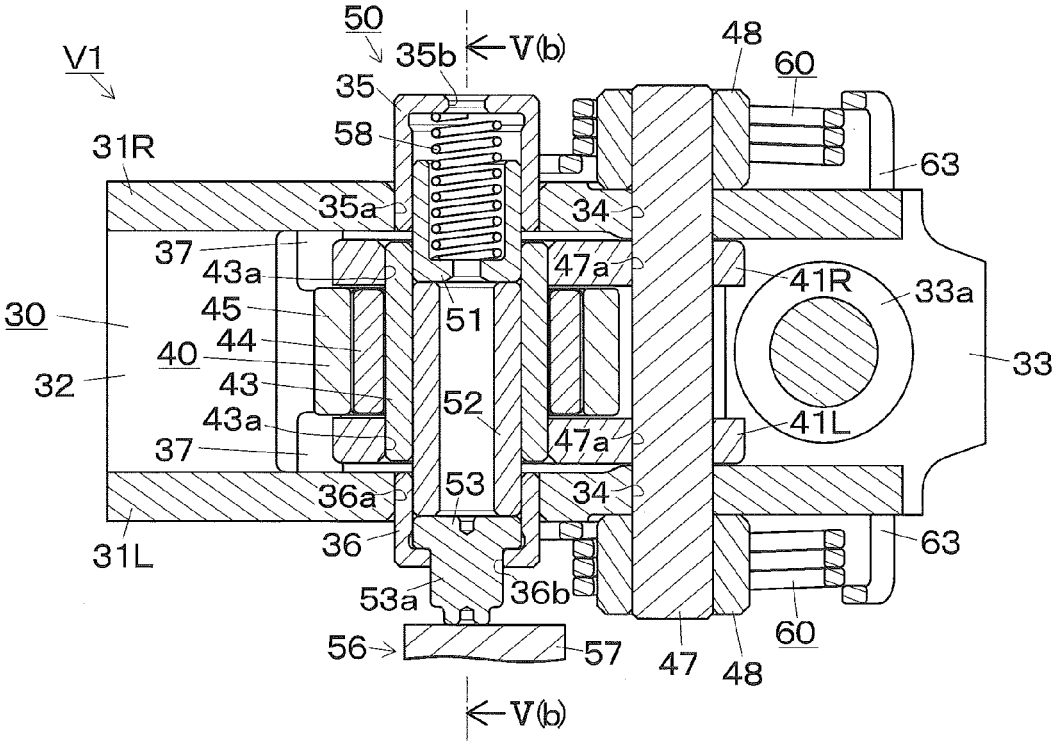
FIG. 4B is a sectional plan view of the variable valve mechanism of the first embodiment.
Figure 5A:
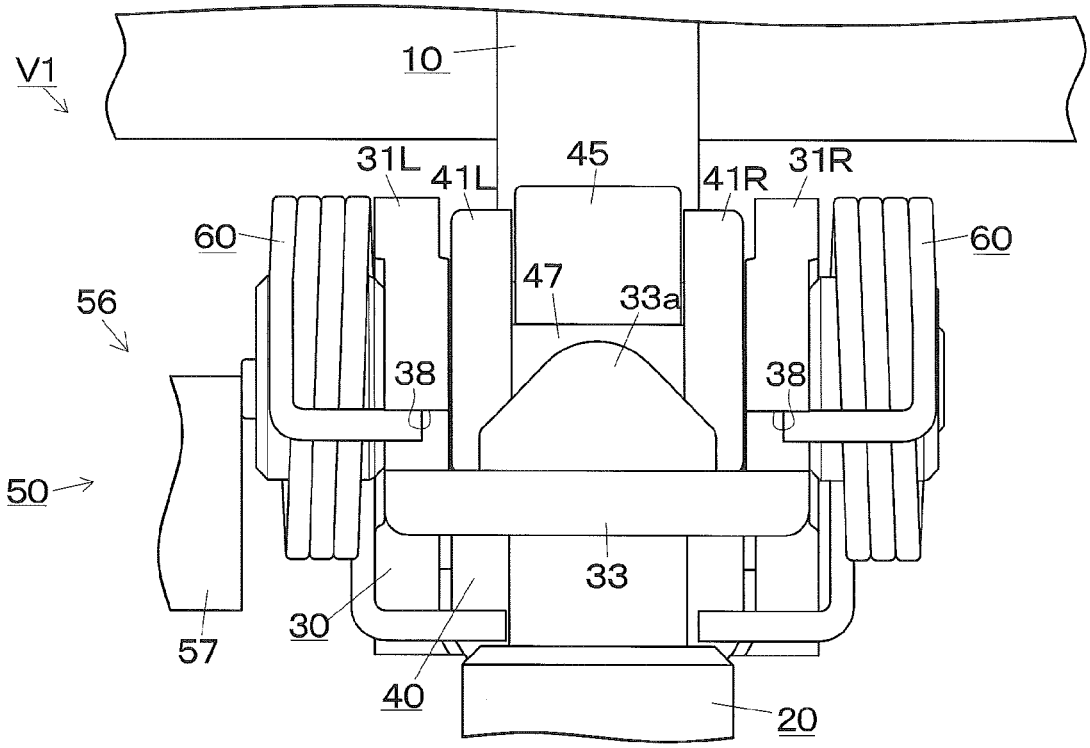
FIG. 5A is a rear view showing the variable valve mechanism of the first embodiment.
Figure 5B:
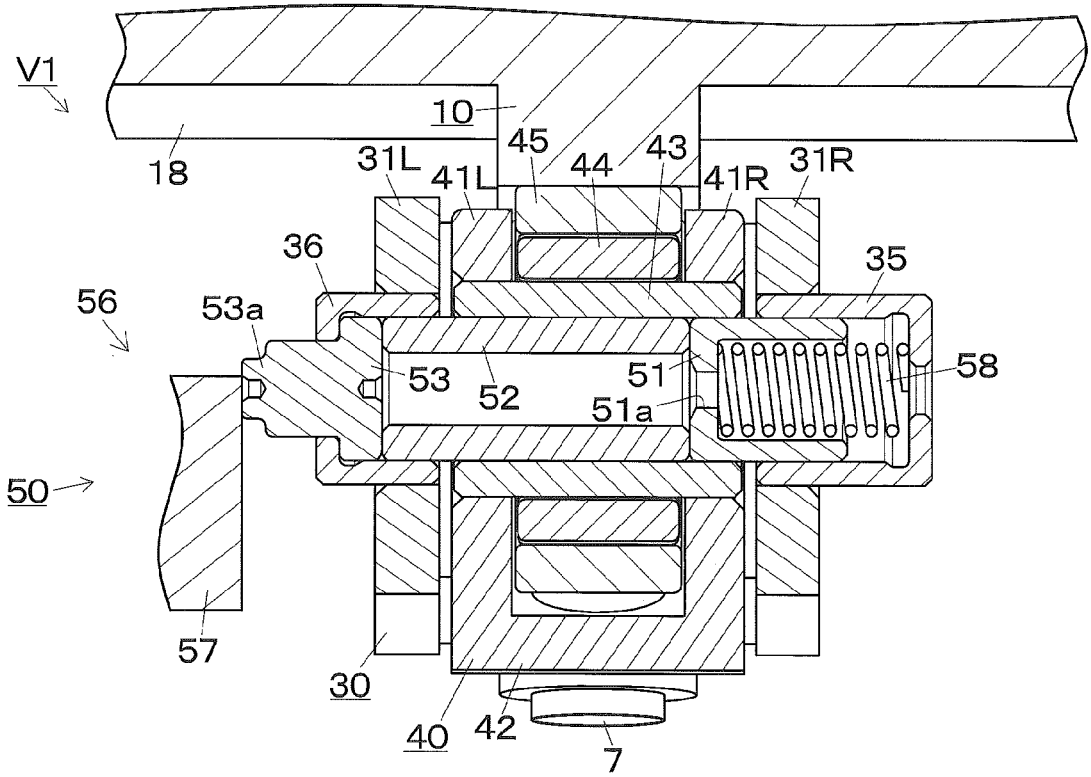
FIG. 5B is a rear sectional view of the variable valve mechanism of the first embodiment.

A variable valve mechanism V1 of an internal combustion engine according to a first embodiment shown in FIGS. 1 to 7B includes a lift cam 10, a lash adjuster 20, a main arm 30, a sub arm 40, and a switching device 50, which will be described below. In the following description, "right" refers to one side of the lateral direction of the main arm 30 and the sub arm 40, and "left" refers to the other side thereof. However, "left" and "right" may be reversed.

[Lift Cam 10]

The lift cam 10 is provided on a camshaft 18 extending in the lateral direction, and rotates together with the camshaft 18 according to rotation of the internal combustion engine. This lift cam 10 includes a base circular portion 11 having a true circular cross section, and a cam nose portion 12 protruding from the base circular portion 11.

[Lash Adjuster 20]

The lash adjuster 20 is formed by inserting a plunger 22 in a bottomed cylindrical body 21 opening upward. In the lash adjuster 20, the plunger 22 can advance upward and withdraw downward. A high pressure oil chamber 23 is formed between the inner bottom of the body 21 and the lower end face of the plunger 22, and a low pressure oil chamber 24 is formed inside the plunger 22. The plunger 22 has a through hole 25 in its lower end face so that oil flows from the low pressure oil chamber 24 in the plunger 22 to the high pressure oil chamber 23 therethrough. A check valve 26 is disposed below the through hole 25. The check valve 26 opens the lower opening of the through hole 25 when the plunger 22 advances upward, and closes the lower opening of the through hole 25 when the plunger 22 withdraws downward. A leakage clearance 27 is formed between the inner peripheral surface of the body 21 and the outer peripheral surface of the plunger 22 so as to allow the oil to leak from the high pressure oil chamber 23 to the low pressure oil chamber 24 when the plunger 22 withdraws. The plunger 22 further has a hemispherical support portion 22*a* at its upper end in order to support a supported portion 33*a* of the main arm 30.

[Main Arm 30]

The main arm 30 is a single-valve drive arm that drives only one valve 7. The main arm 30 is an outer arm disposed laterally outward of the sub arm 40, and is formed by sheet-metal working. The main arm 30 includes two side plate portions 31R, 31L arranged side by side at an interval in the lateral direction, an arm tip end 32 connecting the tip ends of the side plate portions 31R, 31L, and an arm rear end 33 connecting the rear ends of the side plate portions 31R, 31L. The arm tip end 32 has a pressing portion 32*a* on its lower surface in order to press the valve 7 downward to open the valve 7. The arm rear end 33 has the supported portion 33*a* that is continuously supported by the hemispherical support portion 22*a* of the plunger 22 so as to be swingable without floating upward.

The right side plate portion 31R has an attachment hole 35*a* extending through its intermediate region in the longitudinal direction. A first cylindrical member 35 having a bottomed cylindrical shape is attached to the attachment hole 35*a* with the opening of the first cylindrical member 35 facing leftward and the bottom of the first cylindrical member 35 protruding rightward. The first cylindrical member 35 has an air vent hole 35*b* extending through its bottom. The left side plate portion 31L has an attachment hold 36*a* extending through its intermediate region in the longitudinal direction. A second cylindrical member 36 having a bottomed cylindrical shape is attached to the attachment hole 36*a* with the opening of the second cylindrical member 36 facing rightward and the bottom of the second cylindrical member 36 protruding leftward. The second cylindrical member 36 has a pin protrusion hole 36*b* extending through its bottom in order to allow a tip end 53*a* of an intervening pin 53 of the switching device 50 to protrude leftward.

Each of the side plate portions 31R, 31L has an attachment hole 37*a* extending therethrough in a region rearward of the pressing portion 32*a* and forward of the first cylindrical member 35 or the second cylindrical member 36. A stopper 37 is attached to the attachment hole 37*a* so that the stopper 37 contacts the sub arm 40 from above. Each of the side plate portions 31R, 31L has a spring latch recess 38 in its rear end at a position above the arm rear end 33. Each spring latch recess 38 is recessed forward in the rear end of the side plate portion 31R, 31L so as to support a rear part 63 of a lost motion spring 60. Each of the side plate portions 31R, 31L has a support hole 34 extending therethrough in a region rearward of the first or second cylindrical member 35, 36 of the side plate portion 31R, 31L and forward of the supported portion 33*a* in order to support a support pin 47 described below.

[Sub Arm 40]

The sub arm 40 is an inner arm that is provided next to the main arm 30 and disposed laterally inward of the main arm 30, and is formed by sheet-metal working. The sub arm 40 includes two inner plate portions 41R, 41L that are arranged inward of the side plate portions 31R, 31L of the main arm 30 and side by side at an interval in the lateral direction, and a bottom plate portion 42 connecting the lower ends of the tip ends of the inner plate portions 41R, 41L. The bottom plate portion 42 has a weight-reducing hole 42*a* extending therethrough in order to reduce the weight.

Each of the inner plate portions 41R, 41L has an attachment hole 43*a* extending therethrough in a region above the bottom plate portion 42 at the tip end of the inner plate portion 41R, 41L. A cylindrical roller shaft 43 is supported by the attachment holes 43*a*, 43*a*, and a roller 45 is rotatably supported by the roller shaft 43 via bearings 44, 44. The roller 45 contacts the lift cam 10. The center of the roller 45 is located rearward of the pressing portion 32*a* of the main arm 30 and forward of the swing center of the supported portion 33*a*.

The rear end of each of the inner plate portions 41R, 41L has a supported hole 47*a* extending therethrough. The single support pin 47 is inserted through the supported holes 47*a*, 47*a* and the support holes 34, 34 of the main arm 30, so that the rear ends of the inner plate portions 41R, 41L are swingably supported by the side plate portions 31R, 31L of the main arm 30. Both ends of the support pin 47 protrude on both right and left sides of the side plate portions 31R, 31L of the main arm 30, and cylindrical retaining members 48, 48 are fitted on both ends of the support pin 47. The center of the support pin 47 is located rearward of the center of the roller 45 and forward of the swing center of the supported portion 33*a*. The distance L1 from the center of the support pin 47 to the swing center of the supported portion 33*a* is 0.8 to 1.0 times the distance L2 from the center of the support pin 47 to the center of the roller 45 as viewed from the side.

[Switching Device 50]

The switching device 50 is a device that switches between a coupled state where the sub arm 40 is coupled to the main arm 30 so as not to allow the sub arm 40 to swing relative to the main arm 30, and a non-coupled state where the coupling between the sub arm 40 and the main arm 30 is released. The switching device 50 includes a first switch pin 51, a second switch pin 52, the intervening pin 53, a shift device 56, and a return spring 58, which will be described below.

The first switch pin 51 is a bottomed cylindrical pin, and is inserted in the first cylindrical member 35 with an opening of the first switch pin 51 facing rightward. The first switch pin 51 can be shifted between a coupling position where the first switch pin 51 extends from the inner side of the first cylindrical member 35 to the inner side of the roller shaft 43 and a non-coupling position where the first switch pin 51 does not extend from the inner side of the first cylindrical member 35 to the inner side of the roller shaft 43. The first switch pin 51 has an air vent hole 51*a* extending therethrough at its bottom. The second switch pin 52 is a cylindrical pin, and is inserted in the roller shaft 43. The second switch pin 52 can be shifted between a coupling position where the second switch pin 52 extends from the inner side of the roller shaft 43 to the inner side of the second cylindrical member 36 and a non-coupling position where the second switch pin 52 does not extend from the inner side of the roller shaft 43 to the inner side of the second cylindrical member 36. The intervening pin 53 is inserted in the second cylindrical member 36 so that its left tip end 53*a* having a smaller diameter than the remaining part can protrude leftward from the pin protrusion hole 36*b* of the second cylindrical member 36. Thus, the first switch pin 51, the second switch pin 52, and the intervening pin 53 are inserted through the central portion of the roller 45 when in the coupled state.

The shift device 56 is a device that urges the tip end 53*a* of the intervening pin 53 rightward from the outside (the left side) of the main arm 30 and the sub arm 40 to shift the switch pins 51, 52 rightward. The shift device 56 is provided outside the main arm 30 and the sub arm 40, and therefore does not swing together with the main arm 30 and the sub arm 40. The shift device 56 includes a shift portion 57 that contacts the tip end 53*a* of the intervening pin 53 from the left, and a main body (not shown) that urges the shift portion 57 rightward. The shift device 56 may be a hydraulic device that urges the shift portion 57 rightward by an oil pressure, or may be an electromagnetic device that urges the shift portion 57 rightward by a magnetic force. The return spring 58 is interposed between the inner bottom surface of the first cylindrical member 35 and the inner bottom surface of the first switch pin 51, and urges the first switch pin 51 leftward by a restoring force.

[Lost Motion Spring 60, 60]

The lost motion springs 60, 60 are the springs that cause the sub arm 40 to follow the lift cam 10 when in the non-coupled state. The lost motion springs 60 are provided on both sides of the main arm 30 in the lateral direction, one on each side. Each lost motion spring 60 includes a coil portion 62 formed in a coil shape, a front portion 61 extending forward from the coil portion 62, and a rear portion 63 extending rearward from the coil portion 62. The coil portion 62 of each lost motion spring 60 is fitted on the outer peripheral side of the retaining member 48. The front portion 61 of each lost motion spring 60 contacts the lower surface of the inner plate portion 41R, 41L of the sub arm 40, and urges this lower surface upward. The rear portion 63 of each lost motion spring 60 is fitted in the spring latch recess 38 in the rear end of the main arm 30, and urges the upper surface of the spring latch recess 38 upward. Thus, the lost motion springs 60, 60 press the sub arm 40 against the main arm 30 via the switch pins 51, 52 when in the coupled state, and press the sub arm 40 against the lift cam 10 when in the non-coupled state.

The variable valve mechanism V1 in the coupled state and the non-coupled state during operation of the internal combustion engine will be described below.

[1] In the Coupled State

Figure 6A:
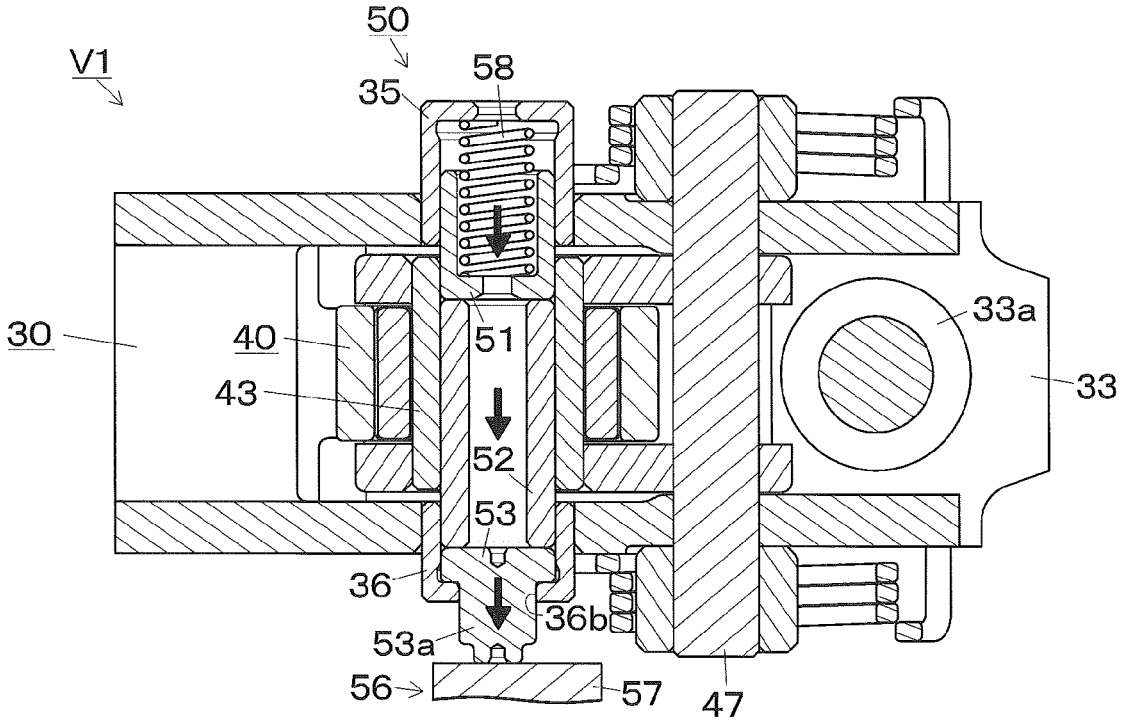
FIG. 6A is a sectional plan view showing a coupled state of the variable valve mechanism of the first embodiment.
Figure 7A:
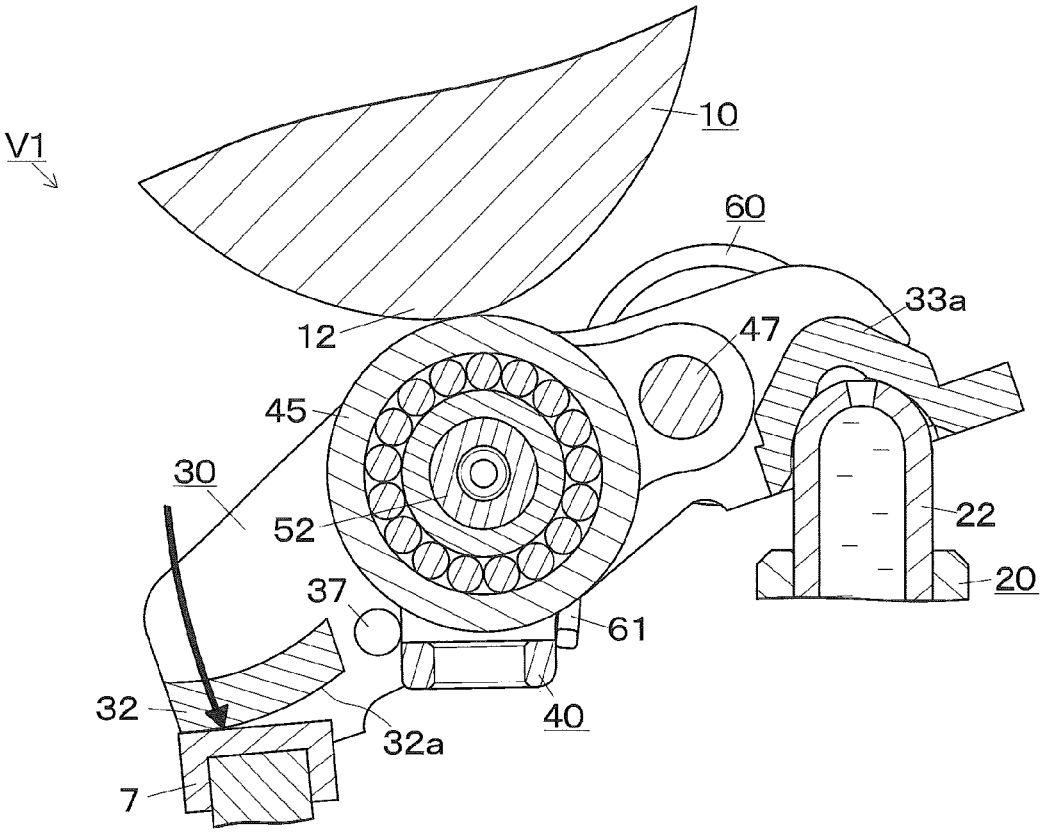
FIG. 7A is a side sectional view showing a coupled state of the variable valve mechanism of the first embodiment.

When in the coupled state, as shown in FIG. 6A, the shift portion 57 of the shift device 56 does not urge the intervening pin 53 rightward. The first switch pin 51, the second switch pin 52, and the intervening pin 53 are therefore shifted leftward on the centerline of the roller 45 by the restoring force of the return spring 58, and the first switch pin 51 and the second switch pin 52 are placed at the coupling position. Thus, the sub arm 40 is not allowed to swing relative to the main arm 30. Accordingly, as shown in FIG. 7A, the main arm 30 and the sub arm 40 swing together to drive the valve 7.

[2] In the Non-Coupled State

Figure 6B:
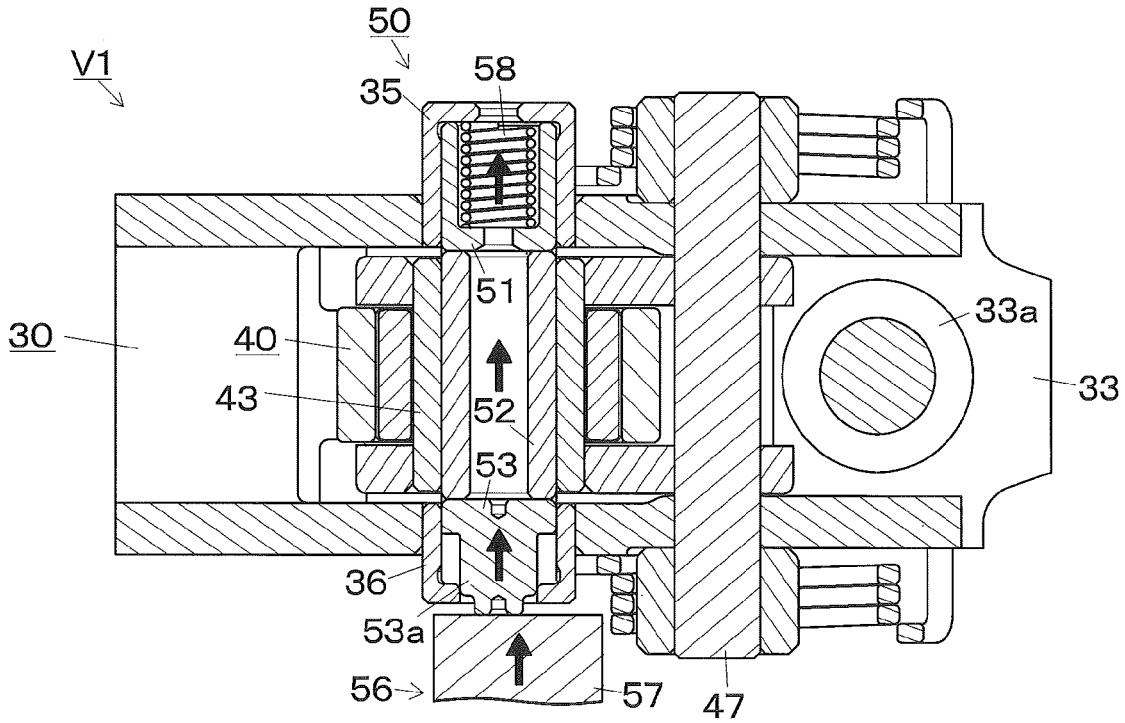
FIG. 6B is a sectional plan view showing a non-coupled state of the variable valve mechanism of the first embodiment.
Figure 7B:
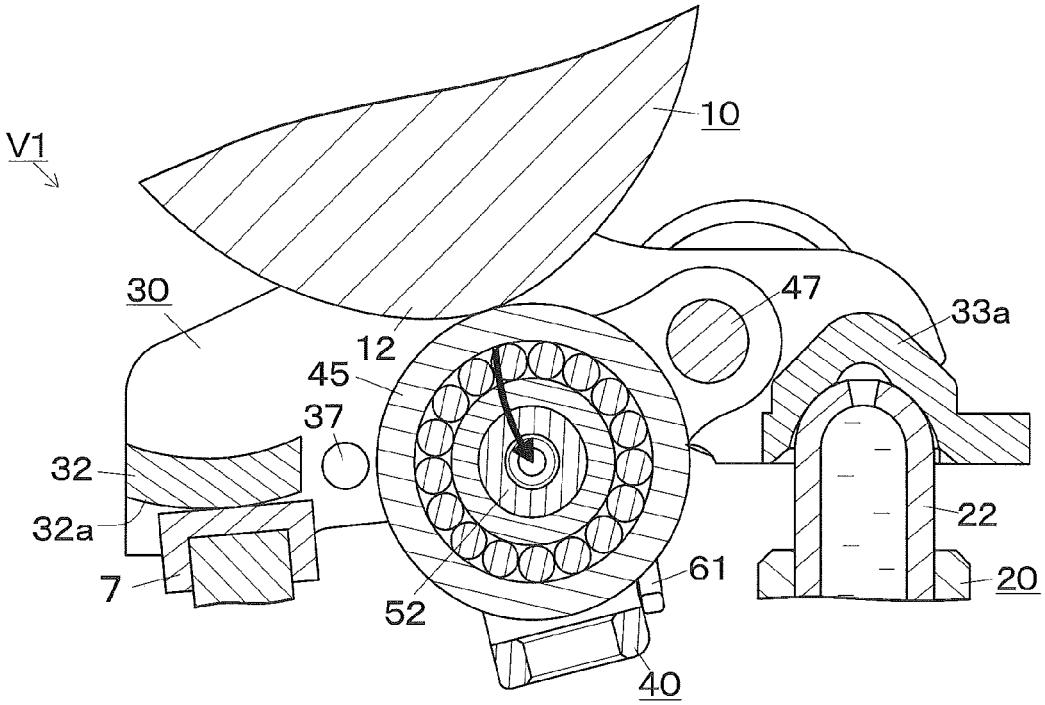
FIG. 7B is a side sectional view showing a non-coupled state of the variable valve mechanism of the first embodiment.

When in the non-coupled state, as shown in FIG. 6B, the shift portion 57 of the shift device 56 urges the intervening pin 53 rightward. The first switch pin 51, the second switch pin 52, and the intervening pin 53 are therefore shifted rightward on the centerline of the roller 45 against the restoring force of the return spring 58, and the first switch pin 51 and the second switch pin 52 are placed at the non-coupling position. Thus, the sub arm 40 is allowed to swing relative to the main arm 30. Accordingly, as shown in FIG. 7B, only the sub arm 40 swings (swings independently) about the support pin 47, and driving of the valve 7 is stopped.

The first embodiment can provide the following effects (A) to (G).

(A) Since the first switch pin 51, the second switch pin 52, and the intervening pin 53 are inserted through the central portion of the roller 45, the pins 51, 52, 53 are arranged on the centerline of the roller 45, thereby making the main arm 30 and the sub arm 40 compact.

(B) Since the center of the support pin 47 that swingably supports the rear end of the sub arm 40 is located rearward of the center of the roller 45, inertial mass upon swinging of the main arm 30 supporting the sub arm 40 is smaller, as compared to the case where the center of the support pin 47 is located forward of the center of the roller 45. Since the center of the support pin 47 is located forward of the swing center of the supported portion 33*a*, the length of the sub arm 40 is smaller in the longitudinal direction and the weight and size of the sub arm 40 are also smaller, as compared to the case where the center of the support pin 47 is located at the same position as or on the lateral side of the swing center of the supported portion 33*a*, or located upward of the swing center of the supported portion 33*a*.

(C) Since the supported portion 33*a* of the main arm 30 is continuously supported by the hemispherical support portion 22*a* of the plunger 22 without floating upward, support of the main arm 30 does not become unstable.

(D) Since the supported portion 33*a* supported by the hemispherical support portion 22*a* of the plunger 22 is provided on the outer main arm 30 rather than on the inner sub arm 40, there is no such restriction that the lateral width of the inner sub arm 40 needs to be greater than the diameter of the supported portion 33*a* by a predetermined amount or more. Since the lateral width of the outer main arm 30 only needs to be made greater than the diameter of the supported portion 33*a* by a predetermined amount or more, the size of the main arm 30 and the sub arm 40 can be reduced in the lateral direction.

(E) Since the shift device 56 is provided outside the main arm 30 and the sub arm 40, the main arm 30 and the sub arm 40 can be reduced in weight and size as compared to the case where the shift device 56 is provided inside the main arm 30 and the sub arm 40. Since the shift device 56 is provided outside the main arm 30, the size of the main arm 30 is reduced in the lateral direction, and the main arm 30 can be used as a single-valve drive arm.

(F) The main arm 30 is a single-valve drive arm. Accordingly, by providing two main arms 30, 30 for two valves 7, 7, the two valves 7, 7 can be driven with separate driving amounts and at separate timings, and two valve clearances can be separately automatically adjusted by the respective lash adjusters 20, 20. Namely, the valve clearance need not be balanced between the two valves 7, 7.

(G) Since the main arm 30 is formed by sheet-metal working, and is formed by the two side plate portions 31R, 31L, the arm tip end 32, and the arm rear end 33, the main arm 30 can be reduced in weight and size. Since the sub arm 40 is formed by sheet-metal working, and is formed by the two inner plate portions 41R, 41L and the bottom plate portion 42, the sub arm 40 can be reduced in weight and size. Since the lost motion spring 60 is provided outside the main arm 30 and the sub arm 40, the main arm 30 and the sub arm 40 can also be reduced in weight and size.

Second Embodiment

Figure 8A:
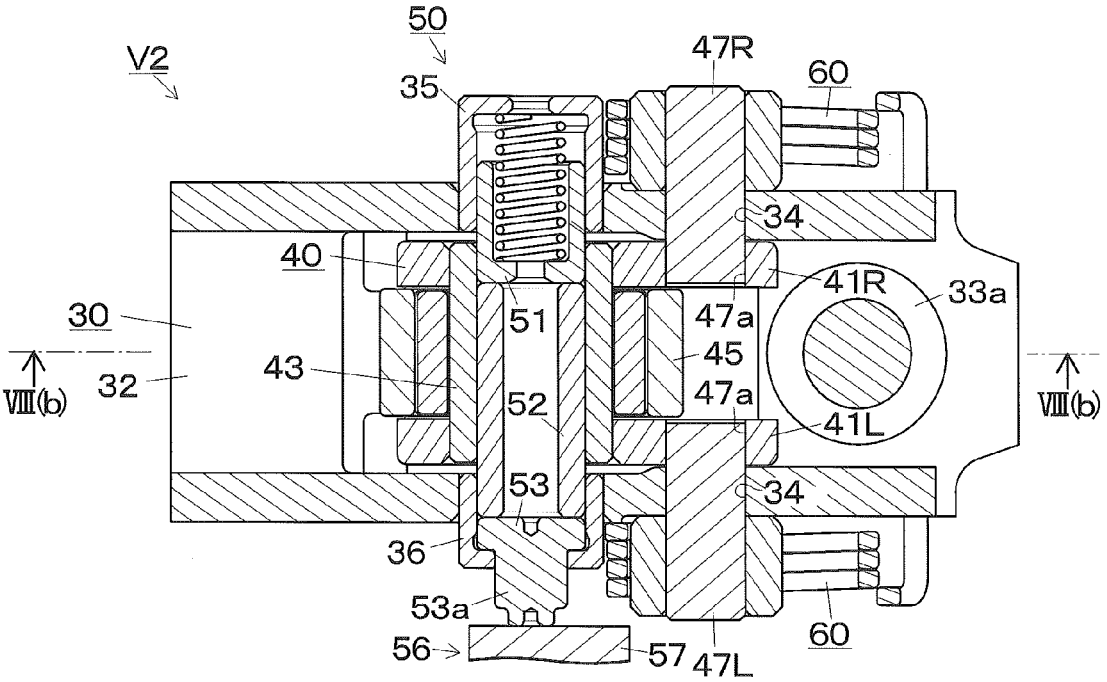
FIG. 8A is a sectional plan view showing a variable valve mechanism of a second embodiment.
Figure 8B:
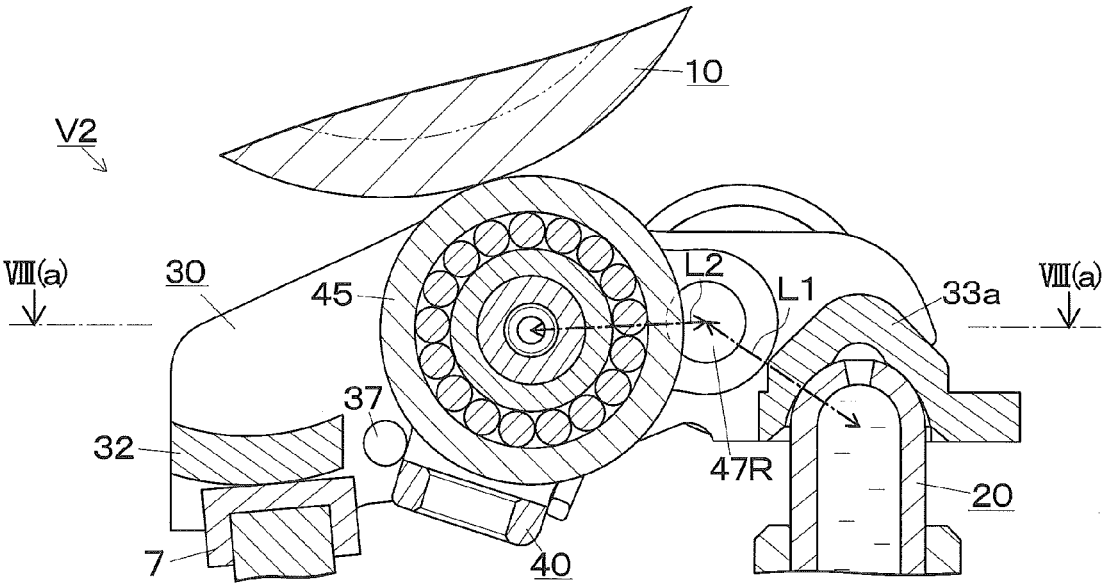
FIG. 8B is a side sectional view of the variable valve mechanism of the second embodiment.
Figure 9:
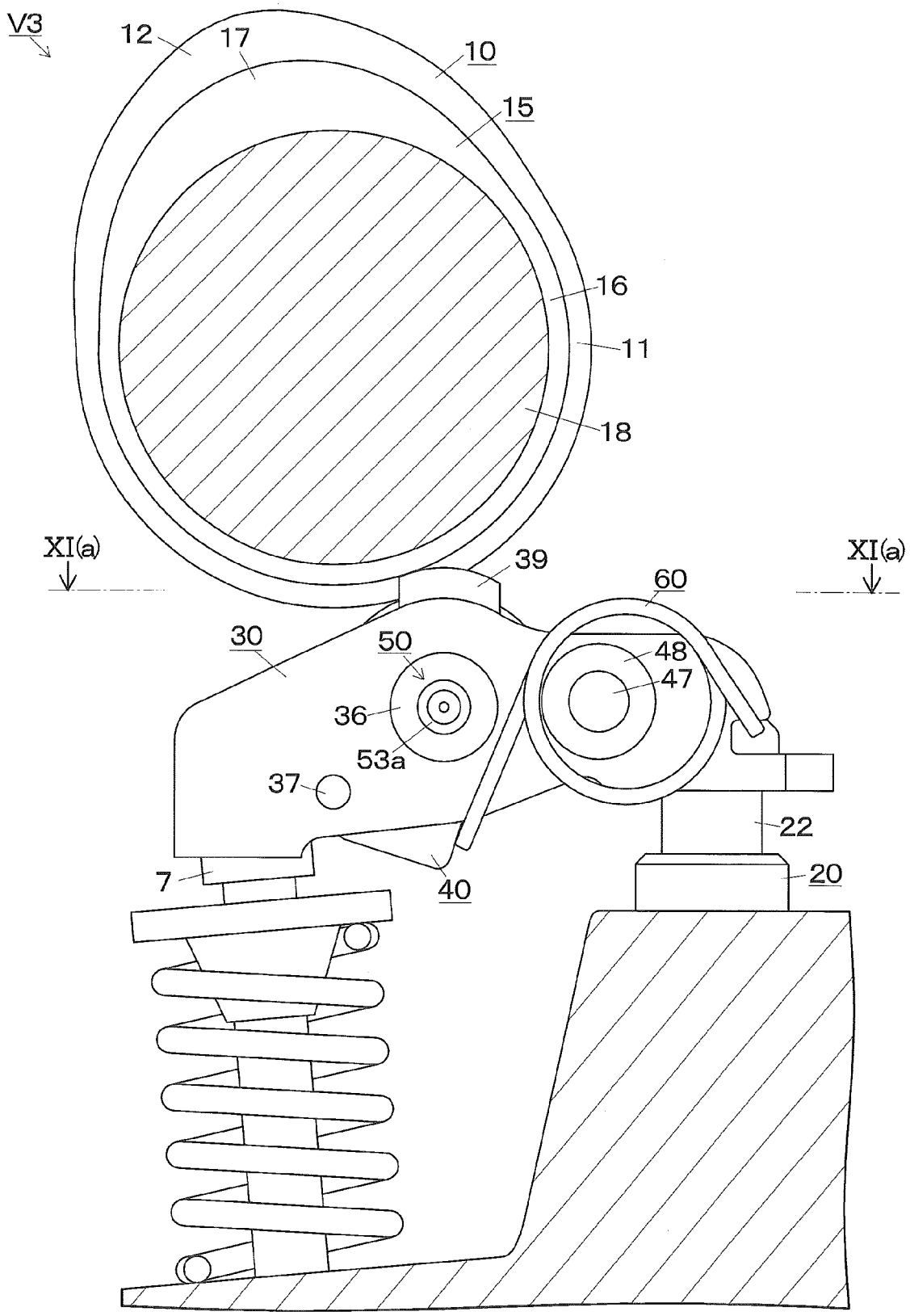
FIG. 9 is a side sectional view showing a variable valve mechanism of a third embodiment.
Figure 10:
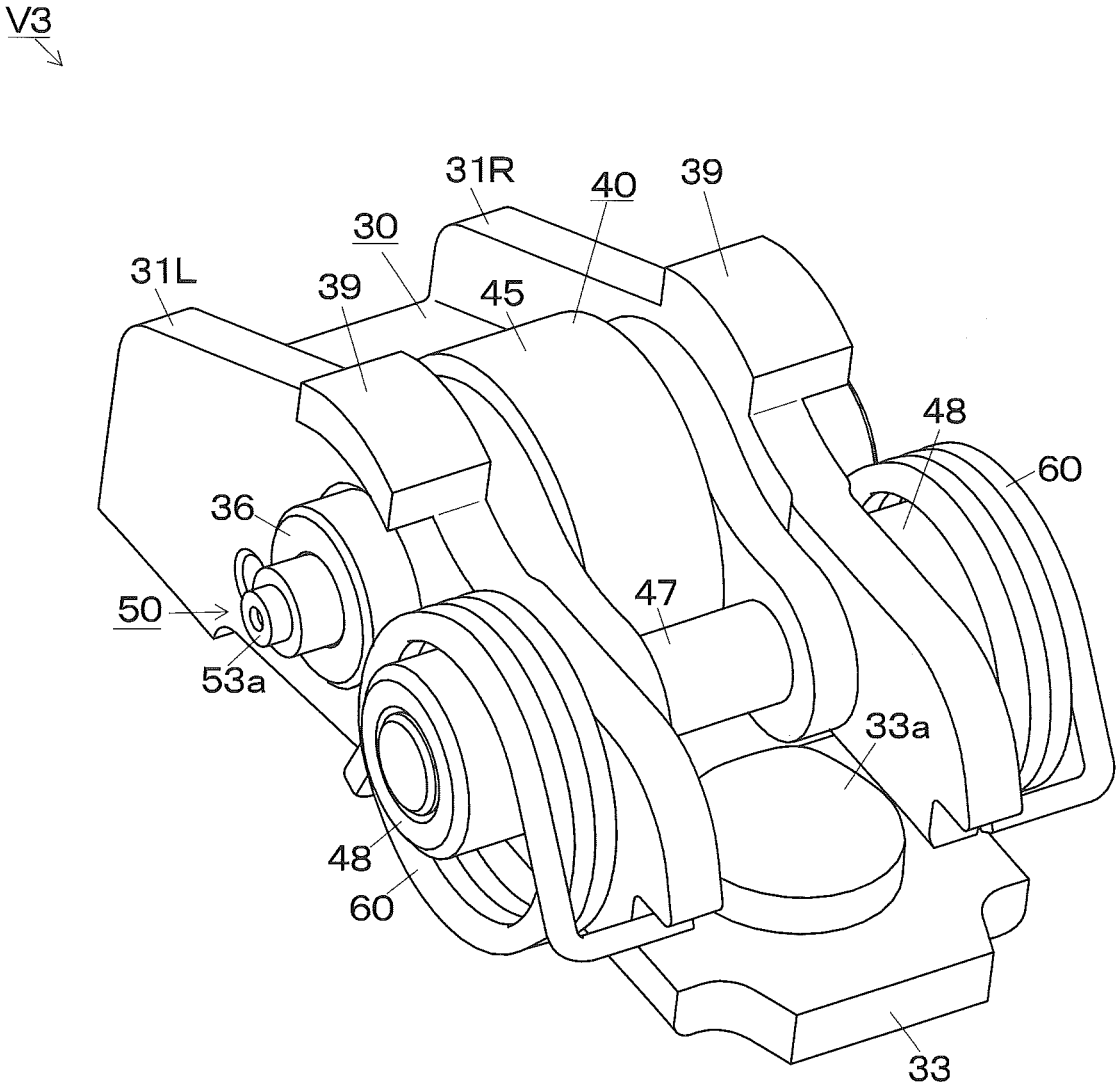
FIG. 10 is a perspective view showing a main arm and a sub arm of the variable valve mechanism of the third embodiment.
Figure 11A:
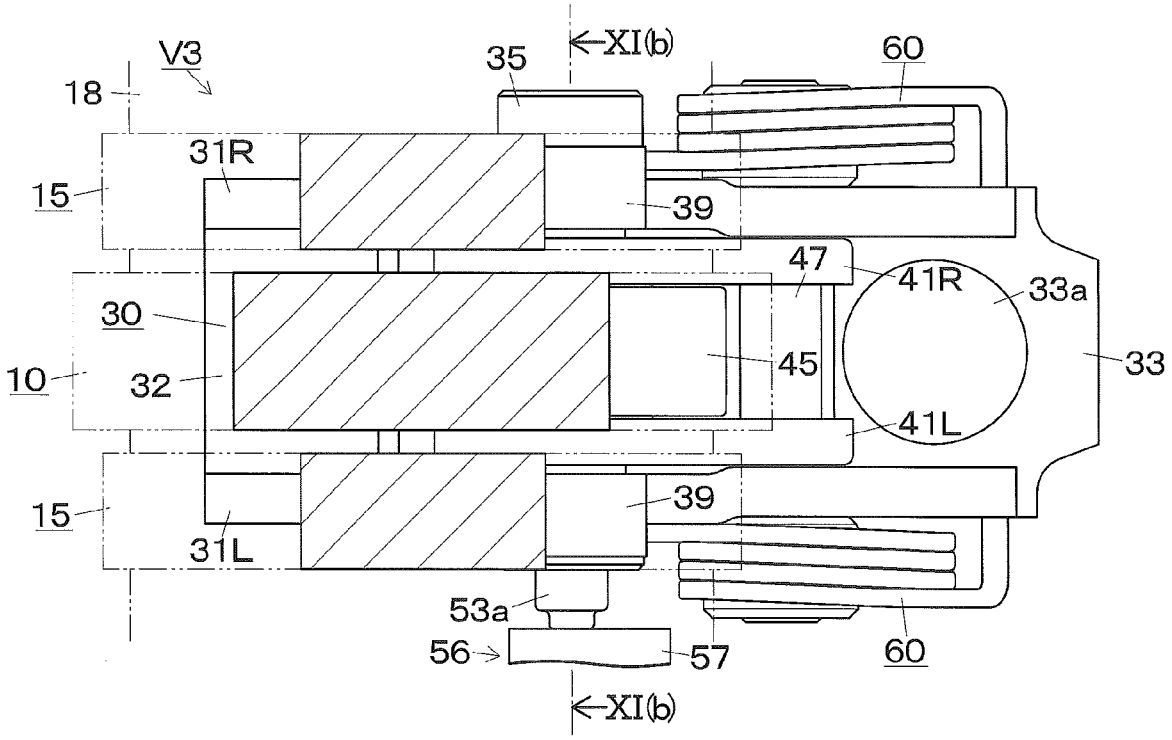
FIG. 11A is a plan view showing the variable valve mechanism of the third embodiment.
Figure 11B:
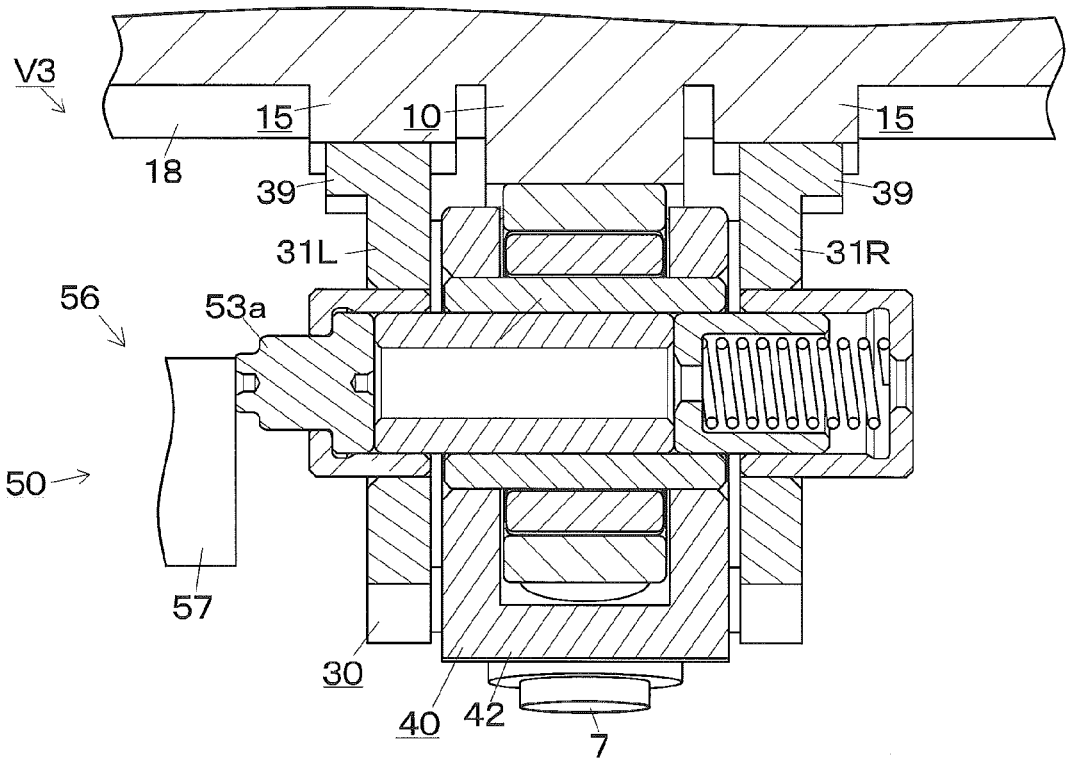
FIG. 11B is a rear sectional view of the variable valve mechanism of the third embodiment.

A variable valve mechanism V2 of an internal combustion engine according to a second embodiment shown in FIGS. 8A and 8B is different from the first embodiment in that the longitudinal interval between the roller 45 and the supported portion 33*a* is shorter than that in the first embodiment, and that the support pin 47 is divided into a right support pin 47R and a left support pin 47L, and the outer edge of the roller 45 is placed between the right support pin 47R and the left support pin 47L. The second embodiment is otherwise similar to the first embodiment.

Specifically, the right support pin 47R is inserted in both the supported hole 47*a* in the right inner plate portion 41R of the sub arm 40 and the support hole 34 of the right side plate portion 31R of the main arm 30, thereby swingably supporting the rear end of the right inner plate portion 41R on the right side plate portion 31R. The left support pin 47L is inserted in both the supported hole 47*a* in the left inner plate portion 41L of the sub arm 40 and the support hole 34 of the left side plate portion 31L of the main arm 30, thereby swingably supporting the rear end of the left inner plate portion 41L on the left side plate portion 31L. The distance L1 from the center of the support pin 47R, 47L to the swing center of the supported portion 33*a* is about 0.9 to 1.1 times the distance L2 from the center of the support pin 47R, 47L to the center of the roller 45 as viewed from the side.

The second embodiment can also be used in the case where the longitudinal interval between the roller 45 and the supported portion 33*a* so short that there is not enough space between the roller 45 and the supported portion 33*a* to insert the single support pin 47 as in the first embodiment therethrough.

Third Embodiment

A variable valve mechanism V3 of an internal combustion engine according to a third embodiment shown in FIGS. 9 to 11B is different from the first embodiment in that low lift cams 15, 15 whose lift amount is lower than that of the lift cam 10 are provided on the right and left sides of the lift cam 10 on the camshaft 18, and that slide portions 39, 39 contacting the low lift cams 15, 15 are provided at the upper ends of the side plate portions 31R, 31L of the main arm 30. The third embodiment is otherwise similar to the first embodiment.

Specifically, each low lift cam 15 includes a base circular portion 16 having a true circular cross section, and a cam nose portion 17 protruding from the base circular portion 16. In each slide contact portion 39, a protruding portion formed at the upper end of the intermediate portion in the longitudinal direction of the side plate portion 31R, 31L is formed by bending laterally outward by sheet-metal press work, and the upper surface of the slide contact portion 39 is additionally subjected to a surface treatment as required.

Since the variable valve mechanism of the third embodiment has the low lift cams 15, 15, driving of the valve is not stopped even in the non-coupled state, and the variable valve mechanism is brought into a low lift drive state where the valve is driven with a smaller lift amount than in the coupled state. Accordingly, the third embodiment can be used in the case where it is desired to switch the variable valve mechanism between the high lift drive state and the low lift drive state, rather than switching the variable valve mechanism between the drive state and the stopped state as in the first embodiment.

The present invention is not limited to the above embodiments, and may be modified as appropriate without departing from the spirit and scope of the invention.

REFERENCE SIGNS LIST

7 valve
10 lift cam
15 low lift cam
20 lash adjuster
22 plunger
22*a* support portion
30 main arm
31R right side plate portion
31L left side plate portion
31 arm tip end
32*a* pressing portion
33 arm rear end
33*a* supported portion
40 sub arm
41R right inner plate portion
41L left inner plate portion
45 roller
47 support pin
47R right support pin

47L left support pin
51 first switch pin
52 second switch pin
56 shift device
V1 variable valve mechanism (example 1)
V2 variable valve mechanism (example 2)
V3 variable valve mechanism (example 3)

The invention claimed is:

1. A variable valve mechanism of an internal combustion engine, comprising:

a main arm having at a tip end thereof a pressing portion that presses a valve, and having at a rear end thereof a supported portion that is continuously supported swingably by a support member without floating upward;

a sub arm which is disposed next to the main arm, which has a tip end to which a roller contacting a cam is rotatably attached, in which a center of the roller is located rearward of the pressing portion and forward of a swing center of the supported portion, which has a rear end that is swingably supported with respect to the main arm by a support pin, and in which a center of the support pin is located rearward of the center of the roller and forward of the swing center of the supported portion; and a switch pin that is inserted in a central portion of the roller, and that can be shifted between a coupling position where the sub arm is coupled to the main arm so as not to allow the sub arm to swing relative to the main arm, and a non-coupling position where the coupling between the sub arm and the main arm is released.

2. The variable valve mechanism of the internal combustion engine according to claim 1, wherein a distance from the center of the support pin to the swing center of the supported portion is 0.5 to 1.5 times a distance from the center of the support pin to the center of the roller as viewed from a side.

3. The variable valve mechanism of the internal combustion engine according to claim 1, wherein the main arm is an outer arm located laterally outward of the sub arm, and the sub arm is an inner arm located laterally inward of the main arm, and the support member is a plunger of a lash adjuster which includes at an upper end thereof a hemispherical support portion that supports the supported portion.

4. The variable valve mechanism of the internal combustion engine according to claim 3, further comprising:

a shift device that is provided outside the main arm and the sub arm, that shifts the switch pin, and that does not swing together with the main arm and the sub arm.

5. The variable valve mechanism of the internal combustion engine according to claim 4, wherein the main arm is a single-valve drive arm that drives only one valve.

6. The variable valve mechanism of the internal combustion engine according to claim 5, wherein the main arm includes two side plate portions arranged side by side at an interval in a lateral direction of the main arm, an arm tip end connecting tip ends of the side plate portions and provided with the pressing portion, and an arm rear end connecting rear ends of the side plate portions and provided with the supported portion.

7. The variable valve mechanism of the internal combustion engine according to claim 6, wherein the sub arm includes two inner plate portions that are arranged between the side plate portions and side by side at an interval in a lateral direction of the sub arm, and a bottom plate portion connecting lower ends of tip ends of the inner plate portions, the roller is attached between the tip ends of the inner plate portions located above the bottom plate portion, and rear ends of the inner plate portions are swingably supported on the side plate portions by the support pin.

8. The variable valve mechanism of the internal combustion engine according to claim 1, wherein the main arm includes two side plate portions arranged side by side at an interval in a lateral direction of the main arm, the sub arm includes two inner plate portions that are arranged between the side plate portions and side by side at an interval in a lateral direction of the sub arm, and the roller is attached between tip ends of the inner plate portions, the support pin is divided into two support pins, one of the support pins swingably supports a rear end of one of the inner plate portions on an adjoining one of the side plate portions, and the other support pin swingably supports a rear end of the other inner plate portion on the other adjoining side plate portion, and an outer edge of the roller is placed between the one support pin and the other support pin.

9. The variable valve mechanism of the internal combustion engine according to claim 1, wherein the main arm includes two side plate portions arranged side by side at an interval in a lateral direction of the main arm, and the sub arm is placed between the side plate portions, and a slide contact portion that slide-contacts another cam different from the cam is formed in an upper end of each of the side plate portions by sheet-metal working.

10. The variable valve mechanism of the internal combustion engine according to claim 9, wherein the another cam is a low lift cam having a lift amount smaller than that of the cam.

11. The variable valve mechanism of the internal combustion engine according to claim 9, wherein the another cam is an idle cam having only a base circle.

* * * * *